US010221608B2

(12) United States Patent
Fever et al.

(10) Patent No.: US 10,221,608 B2
(45) Date of Patent: Mar. 5, 2019

(54) MECHANICAL REDUCER CASE FORMING A GUIDE RAIL, SYSTEM FOR DRIVING AN OPENING

(71) Applicants: Michael Fever, Ouzouer sur Loire (FR); Stephane Hemond, Les Bordes (FR); Francois Lefevre, Ardon (FR); Jean-Louis Robalo, Varennes Changy (FR)

(72) Inventors: Michael Fever, Ouzouer sur Loire (FR); Stephane Hemond, Les Bordes (FR); Francois Lefevre, Ardon (FR); Jean-Louis Robalo, Varennes Changy (FR)

(73) Assignee: INTEVA PRODUCTS, LLC, Troy, MI (US)

( * ) Notice: Subject to any disclaimer, the term of this patent is extended or adjusted under 35 U.S.C. 154(b) by 742 days.

(21) Appl. No.: 13/654,616

(22) Filed: Oct. 18, 2012

(65) Prior Publication Data

US 2013/0098183 A1 Apr. 25, 2013

(30) Foreign Application Priority Data

Oct. 19, 2011 (FR) ..... 11 59456

(51) Int. Cl.
*E05F 15/681* (2015.01)
*E05F 11/48* (2006.01)
*E05F 15/689* (2015.01)

(52) U.S. Cl.
CPC ..... *E05F 11/481* (2013.01); *E05F 15/689* (2015.01); *E05Y 2201/684* (2013.01);
(Continued)

(58) Field of Classification Search
CPC ..... F16H 19/02; F16H 19/06; F16H 57/023; E05F 11/481; E05F 11/483; E05F 11/486; E05F 15/681; E05F 15/689
(Continued)

(56) References Cited

U.S. PATENT DOCUMENTS 6,109,124 A * 8/2000 Chen ..... E05B 81/25 192/54.5
6,516,493 B1 * 2/2003 Seliger ..... E05F 11/486 16/90
(Continued)

FOREIGN PATENT DOCUMENTS

DE 19838347 A1 2/2000
DE 102007014934 A1 9/2008
(Continued)

OTHER PUBLICATIONS

CN Office Action for Application No. 201210401101.0 dated Dec. 24, 2015.
(Continued)

*Primary Examiner* — William C Joyce
(74) *Attorney, Agent, or Firm* — Cantor Colburn LLP

(57) ABSTRACT

A mechanical reducer case for converting a motor torque into a drive torque for an opening is provided, the case forming a guide rail guiding the opening into a closed position or into an open position. Also disclosed is a motorized system for driving an opening including the preceding case and a method for manufacturing the preceding case including a half-shell.

13 Claims, 4 Drawing Sheets

(52) U.S. Cl.
CPC ..... *E05Y 2800/676* (2013.01); *E05Y 2900/55* (2013.01); *Y10T 74/18568* (2015.01); *Y10T 74/2186* (2015.01)

(58) Field of Classification Search
USPC ..... 74/89.2, 89.21, 89.22, 421 A, 606 R
See application file for complete search history.

(56) References Cited

U.S. PATENT DOCUMENTS 8,671,621 B2 * 3/2014 Yoshida ..... E05F 11/486 49/352
8,844,198 B2 * 9/2014 Raisoni ..... B29C 45/1635 264/255
2003/0172755 A1 * 9/2003 Nagai ..... F16C 29/02 74/89.2
2006/0019522 A1 * 1/2006 Kanou ..... H02K 5/225 439/260
2007/0144281 A1 * 6/2007 Inoue ..... F16H 25/2015 74/89.23
2009/0293655 A1 * 12/2009 Tseng ..... F16H 25/2015 74/89.37
2010/0139428 A1 * 6/2010 Roither ..... H02K 7/06 74/89.33

FOREIGN PATENT DOCUMENTS

EP 1101968 A1 5/2001
JP 4-181047 * 6/1992
JP 5-65947 * 3/1993
WO 2006130954 A1 12/2006
WO 2011025815 A2 3/2011

OTHER PUBLICATIONS

English Abstract for DE102007014934A1—Sep. 25, 2008; 1 pg.
English Abstract for DE19838347A1—Feb. 24, 2000; 2 pgs.
English Translation to CN Office Action for Application No. 201210401101.0 dated Dec. 24, 2015.
France Preliminary Search Report and Opinion for Application No. FR1159456; Filing date: Oct. 19, 2011; dated Jun. 25, 2012; 6 pgs.
CN Office Action for Application No. 201210401101.0 dated Feb. 28, 2017.

* cited by examiner

MECHANICAL REDUCER CASE FORMING A GUIDE RAIL, SYSTEM FOR DRIVING AN OPENING

CROSS REFERENCE TO RELATED APPLICATIONS

This application claims priority to French Patent Application No. 11 59 456 filed on Oct. 19, 2011 under 35 U.S.C. § 119, the contents of which are incorporated herein by reference thereto.

BACKGROUND

The present invention relates to a mechanical reducer case forming a guide rail for an opening, as well as a system for driving an opening into a closed position or into an open position.

In automobile construction, a limitation arises from the mass of the multitude of components of the vehicle. For example, the window lifts, which drive the windows, are subject to such a limitation, which also affects the design of all of the members of the window lift. The various members of a window lift are for example: an electric motor supplying mechanical energy for driving the window into a closed position or into an open position; a mechanical reducer converting the torque provided by the electric motor into torque driving the window, for example using an intermediate member such as a slider; a rail for guiding such a slider driving the window.

Each member of the window lift is then subject to limiting the overall mass of the components of the vehicle, the guide rails and window tracks in particular having a non-negligible mass.

There is therefore a need for a window lift having a reduced mass.

SUMMARY OF THE INVENTION

To that end, the one exemplary embodiment of the invention proposes a mechanical reducer case for converting motor torque into driving torque for an opening, the case forming a guide rail guiding the opening into a closed position or into an open position.

According to one alternative embodiment, the case is made from plastic.

According to another alternative embodiment, the case comprises two complementary half-shells, the assembly of the two complementary half-shells defining an inner volume housing the mechanical reducer.

According to another alternative embodiment, the case comprises a half-shell forming the guide rail and defining a volume for housing the mechanical reducer, the half-shell being complementary with another half-shell closing or covering the housing volume of the mechanical reducer to define an inner volume for housing the mechanical reducer when the two half-shells are assembled.

According to another alternative embodiment, the case is suitable for receiving the bearings of the shaft supplying the motor torque for the mechanical reducer, the, or if necessary one, half-shell of the case having positioning stops for positioning the bearings in a direction that is perpendicular to the direction of the shaft and extends along the plane of the half-shell or, if necessary half-shells.

According to another alternative embodiment, the case forms: a shaft; a housing volume, around the shaft, for housing a wheel supplying the torque output of the mechanical reducer.

According to another alternative embodiment, the volume around the shaft for housing the wheel is also a volume for housing a drum using a cable to drive the opening along the guide rail formed by the case.

According to another alternative embodiment, the guide rail formed by the case is a window lift guide rail for a motor vehicle door, the case including interfaces for fastening to a door of the motor vehicle, the fastening interfaces being arranged: at two opposite ends of the guide rail in a main extension direction of the guide rail; and also, preferably, at a portion of the case defining a volume for housing the mechanical reducer.

According to another alternative embodiment, the case defines a volume for housing an electronic controller controlling actuation of the opening into a closed position or into an open position.

According to another alternative embodiment, the case includes a connection interface arranged to be electrically connected to an electronic controller received in a housing volume of the electronic controller of the case and arranged to receive an electric cable connector outside the case.

According to another alternative embodiment, the case forms a separating wall between the housing volume of the mechanical reducer and the housing volume of the electronic controller.

According to another alternative embodiment, the case includes a volume housing a magnetic ring for positioning the shaft supplying the motor torque of the mechanical reducer.

According to another alternative embodiment, the case includes an interface for mounting a motor assembly including a stator and rotor; the mounting interface being: either arranged to receive the motor assembly in a mounted position by translating the motor assembly in the extension direction of the rotor; or of the bayonet type.

According to another alternative embodiment, the case includes a volume for receiving brush holders in a position where the brush holders come into contact with a rotor collector when the motor assembly is received in the mounted position by the mounting interface, the volume for receiving the brush holders being if necessary the volume for housing the magnetic positioning ring.

In yet another embodiment a mechanical reducer case for converting motor torque into driving torque for an opening is provided, the case comprising a half-shell forming a guide rail guiding the opening into a closed position or into an open position, the half-shell defining a volume for housing the mechanical reducer, the housing volume being suitable for housing a shaft supplying the motor torque for the mechanical reducer.

In yet another alternative embodiment a system for driving a motorized opening is provided, the system including: one of the preceding cases, the driving system also including: a mechanical reducer for converting a motor torque into a driving torque driving the opening along the guide rail, the mechanical reducer being housed in a volume of the case.

According to one alternative, the drive system also includes a motor assembly including a stator, a rotor, and a collector on the rotor, the case having a mounting interface: either receiving the motor assembly in a mounted position after translating the motor assembly in the extension direction of the rotor, or of the bayonet type around the extension direction of the rotor.

According to one alternative, the drive system also includes brush holders coming into contact with the collector, the brush holders being housed in a volume defined by the case.

According to one alternative, the motor assembly also includes brush holders in contact with the collector and a housing receiving the brush holders.

According to one alternative, the motor assembly also includes an electronic controller controlling the actuation of the opening into a closed position or into an open position and the housing receiving the electronic controller.

According to one alternative, the motor assembly also includes a magnetic positioning ring on the rotor, the housing receiving the brush holders also receiving the magnetic ring of the motor assembly.

According to one alternative, the drive system also includes an electronic controller controlling the actuation of the opening into a closed position or into an open position, the controller being housed in a volume defined in the case.

According to one alternative, the case includes a connection interface arranged to be electrically connected to the electronic controller received in the volume housing the electronic controller of the case and arranged to receive an electric cable connector outside the case.

According to one alternative, the case forms a separating wall between the housing volume of the mechanical reducer and the housing volume of the electronic controller.

According to one alternative, the system also includes a magnetic positioning ring on the shaft supplying the motor torque to the mechanical reducer, the magnetic ring being housed in a volume defined by the case, if applicable in the volume housing the brush holders.

According to one alternative, the mechanical reducer includes a wheel supplying the torque output of the mechanical reducer, the wheel forming a drum using a cable to drive the opening along the guide rail formed by the case.

The invention also proposes a method for manufacturing the preceding case, by pouring or molding without undercut by drawer of a half-shell forming at least one portion of the case.

BRIEF DESCRIPTION OF THE DRAWINGS

Other features and advantages of the invention will appear upon reading the following detailed description of embodiments thereof, provided solely as an example and in reference to the drawings, which show.

DETAILED DESCRIPTION

Figure 1:
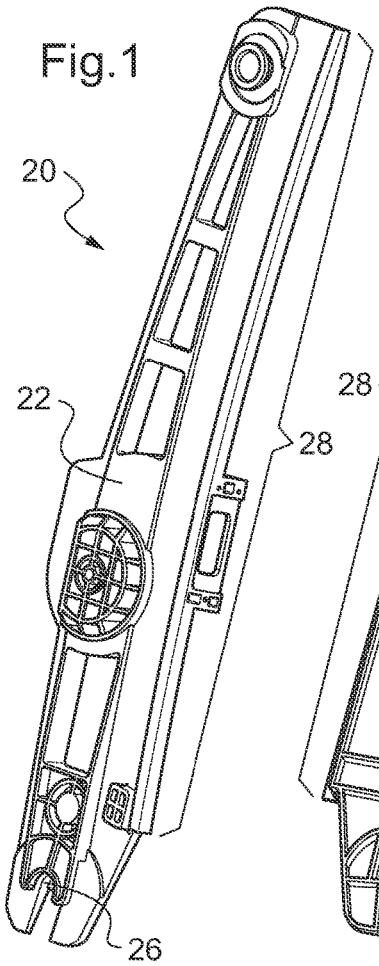
FIG. 1, a front perspective view of a half-shell of a mechanical reducer case forming a guide rail.

Various exemplary embodiments of the present invention are directed to a mechanical reducer case.

In other words, the proposed case defines a volume for housing the mechanical reducer. The mechanical reducer whereof the case is proposed converts a motor torque into a driving torque. This mechanical reducer typically corresponds to a gear, illustrated hereafter in the form of a cooperation between a worm screw and a pinion.

The mechanical reducer whereof the case is proposed provides a torque output for example driving an opening, such as a motor vehicle door window or any other opening in the automobile field, into a closed position or into an open position. The mechanical reducer is sized to drive the opening, and the size of the volume housing the mechanical reducer is then adapted to such sizing. In other words, the proposed case is adapted, in particular in terms of size, to the sizing of the mechanical reducer supplying a torque output for driving an opening.

The housing in the case, i.e., in a volume defined by the case, of the mechanical reducer forms a system for driving the opening. Such a system for driving an opening is also proposed, in particular a motorized system for driving an opening, in the case where the energy for driving the opening comes from an electric motor. Alternatively, the proposed driving system may be actuated manually.

In this document, reference is made to a window lift as an illustration for the proposed system for driving an opening. The proposed system described in the example of a window lift may nevertheless correspond to any other type of system for driving an opening, in particular in the automobile field, such as a system for driving a sunroof. The term "opening" used hereafter may thus for example designate a motor vehicle door window or a motor vehicle sunroof.

Known cases perform a housing function for their mechanical reducer, for example by completely surrounding the mechanical reducer in an inner volume of the case.

The proposed case, in addition to defining a volume for housing the mechanical reducer, also forms a guide rail guiding the opening into a closed position or into an open position. The system for driving an opening including the proposed case may then be of the so-called "cable and drum" type. The so-called "cable and drum" type of system for driving the opening transmits the drive torque to the opening by means of a slider guided along the guide rail, the slider being connected to the outlet of the mechanical reducer by a cable winding a drum receiving the drive torque supplied by the mechanical reducer.

The proposed system for driving the opening may thus transmit the drive torque to the opening using a slider guided along the rail formed by the case of the mechanical reducer. In other words, the proposed case is a guide rail for a slider of an opening performing a mechanical reducer case function, as the case defines a volume suitable for housing the mechanical reducer supplying the torque for driving the opening along the guide rail as output.

The proposed case, by synergistically performing the two functions of guiding and of housing the mechanical reducer, makes it possible to decrease the overall mass of the system formed by the mechanical reducer assembled to the guide rail. This decrease in the overall mass is considerable in comparison, for example, with a known guide rail on which a mechanical reducer is fastened completely surrounded in a known case, the proposed case making it possible to do away with material between the mechanical reducer and the guide rail. Furthermore, the proposed case also makes it possible to limit the number of fastening points on the case, which also contributes to decreasing the mass of the assembly. Furthermore, by integrating the housing function of the mechanical reducer, the number of fastening points specifically sized to mechanically withstand the torque supplied as output from the mechanical reducer is limited, which also contributes to decreasing the mass of the assembly.

Lastly, the proposed case makes it possible to obtain a reduced mass for a system for driving a motorized opening, for example such as a window lift.

In the case where the proposed drive system is a window lift for a motor vehicle door, the case may include interfaces for fastening to a motor vehicle door. The interfaces for fastening to the door are for example arranged at two opposite ends of the guide rail in a main extension direction of the guide rail. It is preferred that a fastening interface to the door also be provided at a portion of the case defining the volume housing the mechanical reducer.

Moreover, when the proposed drive system is a window lift, it may be provided to adapt the system so that the mounting of the system in the door of the vehicle is done essentially by mounting with vertical insertion of the guide rail in the door. This makes it possible to reduce the time needed to mount the proposed system in the door.

According to one preferred embodiment, the case is made from plastic and a plastic guide rail is proposed. Such an embodiment of the case and the guide rail is particularly advantageous in terms of mass savings relative to a known guide rail made from metal. To improve the rigidity of the guide rail formed by the case, the case may include ribs along the guide rail. Such ribs are preferably oriented substantially in the main extension direction of the guide rail so as to improve the stiffness in flexure of the guide rail. In this document, the main extension direction of the guide rail corresponds to the guide direction of the rail, with the understanding that in the case where the rail ensures guiding along a non-rectilinear path, the guide direction of the rail is defined by the direction of the segment with the shortest average distance from the guide path.

The proposed case may comprise of a first half-shell complementary with a second half-shell. The first half-shell, as proposed case, forms the guide rail and defines the housing volume of the mechanical reducer. The second shell closes or covers the volume defined by the first half-shell for housing the mechanical reducer. The volume thus closed by the second shell then becomes an inner volume for the assembly of the two half-shells.

Figure 2:
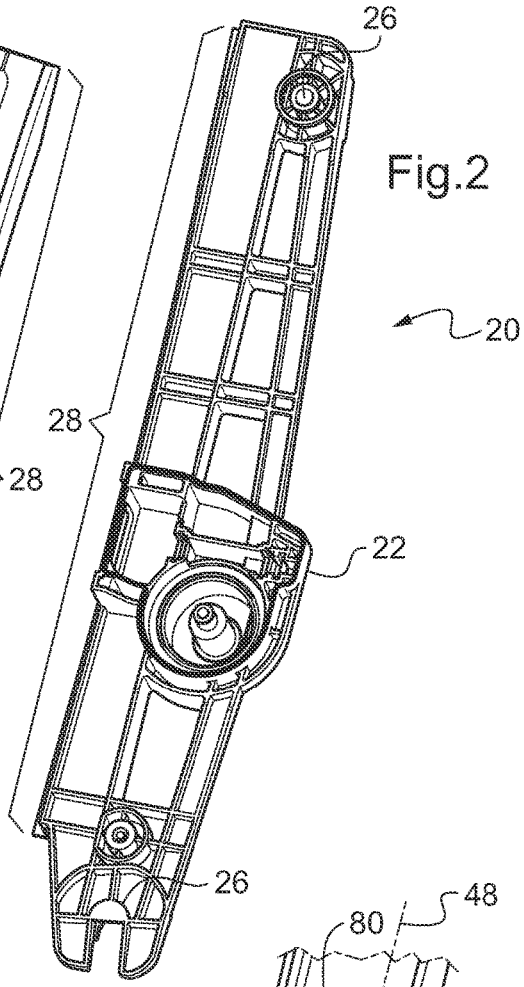
FIGS. 2 and 3, an enlarged rear perspective view of a half-shell of a mechanical reducer case forming a guide rail.

Alternatively, the proposed case may comprise two complementary half-shells. The volume defined by the case for housing the mechanical reducer then corresponds to an inner volume of the case defined by the assembly of the two complementary half-shells. In this embodiment, the case then completely surrounds the mechanical reducer to form the proposed drive system. According to this alternative, the guide rail may be formed by only one of the half-shells or by assembling two half-shells. FIG. 1 shows a front perspective view of a half-shell 22 of the case 20, the half-shell 22 alone forming the guide rail 28. FIG. 2 shows a rear perspective view of the half-shell 22. According to the FIGS. 1 and 2, the half-shells are each integral, i.e. each one of the half-shells is formed of a single piece.

FIGS. 1 and 2 thus illustrate both the embodiment of the case 20 made up of the half-shell 22 and the embodiment of the case 20 made up of two half-shells, where only the half-shell 22 completely forming the guide rail is shown. For these two embodiments, the half-shells are complementary with one another in that their assembly closes or covers the housing volume of the mechanical reducer to define an inner housing volume of the mechanical reducer when the two half-shells are assembled. In the rest of the description, the expression "case 20" designates both of the alternative embodiments described above, unless otherwise explicitly mentioned.

Figure 3:
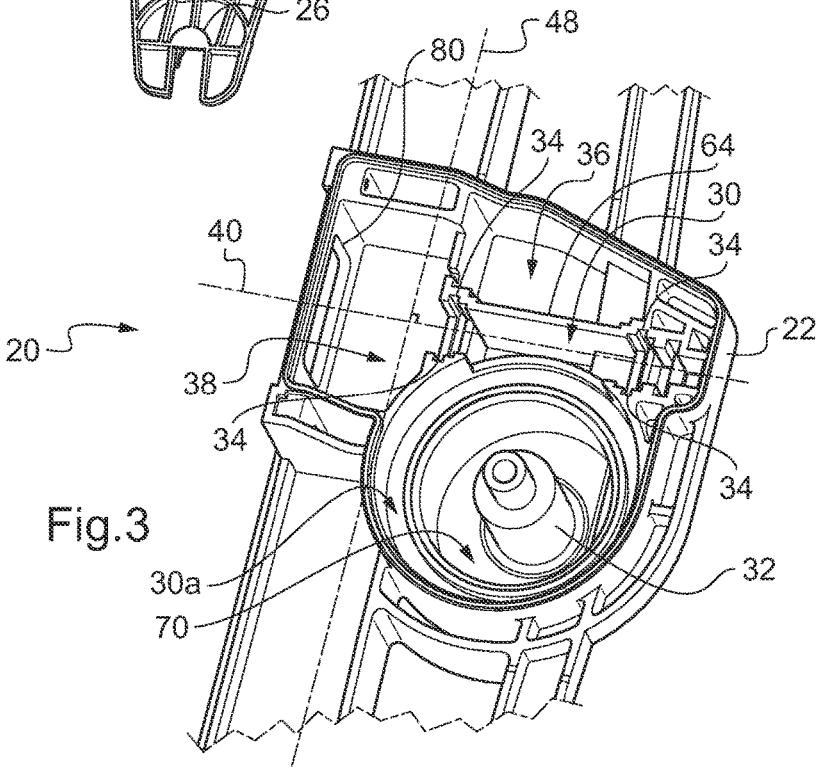
Figure 4:
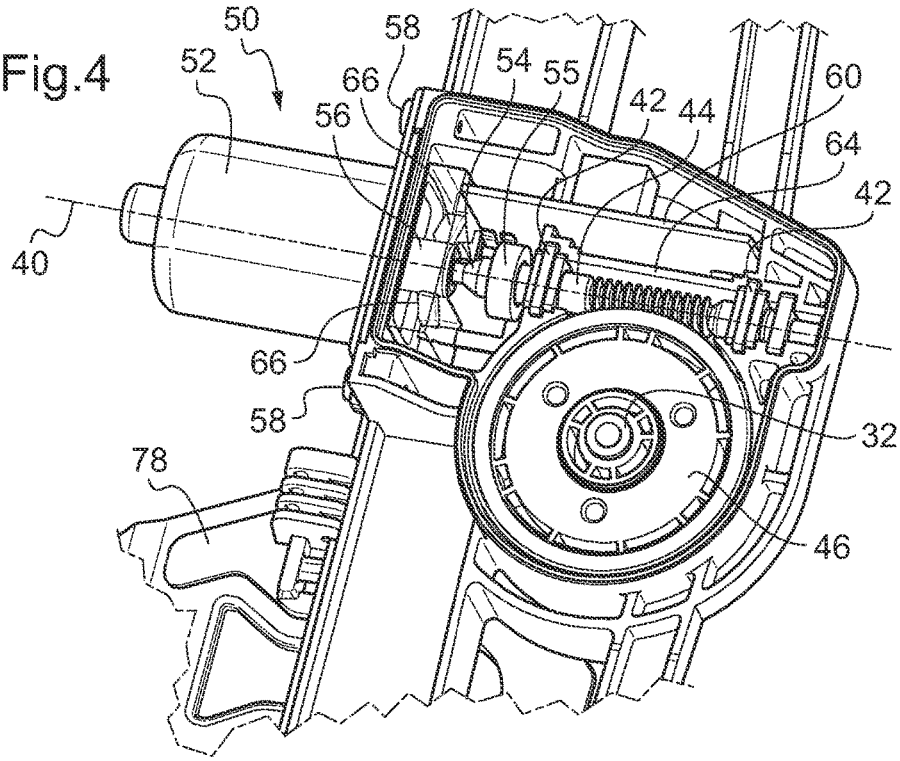
FIG. 4, a view of a half-shell of a mechanical reducer case forming a guide rail, said half-shell housing different members of a system for driving a motorized opening.

FIG. 3 shows an enlarged view of FIG. 2 at the housing volume 30 of the mechanical reducer. In FIGS. 1 to 3, the half-shell 22 of the case 20 is shown empty. FIG. 4 shows an enlarged view of the half-shell 22 housing different members that may be part of the proposed drive system. The proposed drive system as illustrated in FIG. 4 in particular includes the mechanical reducer, here made up of a wheel 46 and a worm screw 44 for producing gear.

The wheel 46 may make up the output of the mechanical reducer in that the wheel 46 supplies the driving torque for the opening, i.e., the torque output of the mechanical reducer. The wheel 46 is mounted freely rotating around the shaft 32. In reference to FIG. 3, the housing volume 30 of the mechanical reducer may include a sub-volume 30*a* (hereafter referred to as volume 30*a*) for housing the wheel 46 around the shaft 32. According to one particular embodiment, the shaft 32 may be made up of the case 20, here by the half-shell 22 as illustrated in FIG. 3. In other words, the shaft 32 may form a single piece with the case 20, for example with the half-shell 22 completely forming the guide rail 28. This embodiment is advantageous by making it possible to facilitate mounting of the proposed drive system, for example by making it possible to eliminate an additional step for inserting a mechanical reducer wheel shaft in a corresponding housing of a mechanical reducer case.

Figure 5:
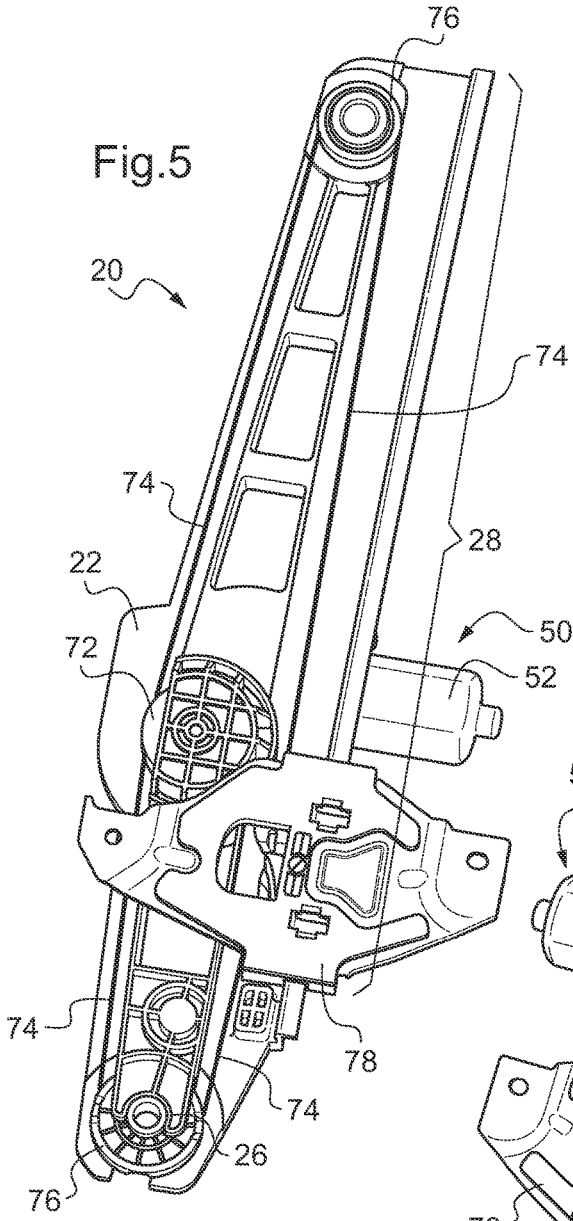
FIG. 5, an overall front perspective view of the case of FIG. 4.

Furthermore, as an improvement or alternative to the embodiment of the shaft 32 made in a single piece with the case 20, the proposed case 20 may include a volume 70 housing a drum around the shaft 32, as illustrated in FIG. 3. According to this embodiment, the case 20 is then suitable for housing a drum (not shown in FIG. 4) between the wheel 46 and the half-shell 22. FIG. 5 shows a front perspective overall view of the case 20, FIG. 4 being an enlarged view of the rear of the case 20. FIG. 5 makes it possible to see the drum 72 when it is housed in the volume 70 previously described. The proposed system, when it includes the drum 72, corresponds to an opening driving system of the so-called "cable and drum" type. In such a system, according to one proposed embodiment, the drum 72 housed by the case 20 receives the drive torque supplied by the mechanical reducer, to wind and/or unwind a cable 74 connected to a slider 78 movable on the guide rail 28. In other words, the drum 72 makes it possible to drive the opening using a cable. Cable returns may also be provided at the end of the guide rail 28 to ensure circulation of the cable 74 along the guide rail. In the illustration of FIG. 5, these cable returns are shown in the form of pulleys 76 mounted freely rotating on the case 20. According to one alternative embodiment, one or more cable returns may be made in the form of a ramp assuming the form of a groove in which the cable slides. According to this embodiment, the ramp-shaped cable return may advantageously be in a single piece with the case 20 or may be fastened to the case 20. The case 20 forming the guide rail 28, bearings 26 may be adapted to receive the pulleys 76. The bearings 26 may advantageously be formed in the case 20, as illustrated by FIG. 5. According to the embodiment of the case 20 with a volume 70 for housing the drum, the shaft 32 may be shared by the wheel 46 and the drum 72. According to this embodiment with the shaft 32 shared by the wheel 46 and the drum 72, the volumes 30*a* and 70 make up the volume for housing the wheel 46 and drum 72.

One advantage of the case 20 uniting the functions of housing the mechanical reducer and guiding the opening is that, in the drive system including the proposed case 20, the wheel 46 of the mechanical reducer and the drum 72 for driving the opening using a cable may be a single piece.

Returning to FIG. 4, the worm screw 44 may make up shaft supplying the motor torque for the mechanical reducer. In fact, according to the illustrated embodiment, the system also includes a motor assembly 50 comprising a stator formed by the yoke 52 and for example by magnets fastened inside (not shown, as they are hidden by the yoke 52) and a rotor 54, where the rotor 54 is a single piece with the worm screw 44. According to one alternative embodiment, not shown, the rotor 54 of the motor assembly 50 is not combined with the worm screw 44, i.e., the rotor 54 is separate from the worm screw 44. According to the latter alternative embodiment, the worm screw 44 nevertheless remains the shaft supplying the motor torque for the mechanical reducer, hereafter designated "motor shaft."

In reference to FIG. 4, the worm screw 44 is mounted freely rotating relative to the case 20 using bearings 42. The positioning of the bearings 42 defines the direction 40 of the motor shaft. According to one preferred embodiment, the case 20 is suitable for receiving such bearings 42. In fact, in reference to FIG. 3, the case 20, by means of its half-shell 22, may include stops 34 for positioning the bearings 42. The stops 34 of the case 20 here are made in the form of notches. These stops 34 allow precise positioning of the bearings 42, and consequently precise positioning of the direction 40 of the motor shaft. This precise positioning of the bearings 42 and the direction 40 is ensured at least in the direction 48, shown in FIG. 3. This direction 48 corresponds to a direction that is both perpendicular to the direction 40 of the motor shaft and a direction extended in the plane of the half-shell 22. In fact, the half-shell 22 defines a half-shell plane corresponding to the junction plane between the half-shell 22 and the complimentary half-shell previously described, with the understanding that when the junction between the two half-shells is not done exactly in a plane, the junction plane is defined as being the plane having the smallest average distance from the junction. To allow insertion of the drum 72 and the wheel 46 around the shaft 32, the junction plane is preferably substantially parallel to the plane normal to the shaft 32.

The precise positioning of the direction 48 allowed by the stops 34 ensures very great precision of the distance between the axis of rotation of the worm screw 44 and the axis of rotation of the wheel 46. Furthermore, the half-shell 22 including the stops 34 and the shaft 32 may advantageously be obtained pouring or molding without undercut by drawer. In other words, the half-shell 22 including the stops 34 and the shaft 32 may be manufactured without using a drawer in the mold used for manufacturing. In the absence of a mold drawer defining the position of the stops 34 and of the shaft 32, it is possible to obtain the desired distance between the worm screw 44 and the wheel 46 very precisely. Thus, a method is also proposed for manufacturing the case 20 pouring or molding without an undercut by drawer for at least one of the half-shells.

In the particular embodiment illustrated in FIG. 3, the direction 48 also corresponds to the main extension direction of the guide rail 28 formed by the case 20. However, alternatives (not shown) of this embodiment may be considered, with a direction 40 of the motor shaft of the mechanical reducer oriented along any straight line of the plane normal to the shaft 32 of the drum 72. In other words, the proposed case 20 makes it possible to integrate the mechanical reducer with a motor shaft according to all possible orientations around the shaft 32 of the drum 72. This ability to orient the direction 40 of the motor shaft of the mechanical reducer facilitates the design of the drive system. This ability is in particular allowed due to the integration by the guide rail of the mechanical reducer case function. According to these alternatives, the direction 48 may not be mixed up with the main direction of the guide rail 28.

Returning to FIG. 4, the proposed system may include an electronic controller 60, here shown in the form of an electronic board or printed circuit. Such a controller 60 makes it possible to control the actuation, by the system, of the opening into an open position or into a closed position. This controller 60 in particular ensures control of the power supply of the motor 50. The controller 60 may correspond to an electronic control unit (ECU). The proposed case 20 is advantageously adapted to the housing of the controller 60 by forming a volume 36 for housing the controller 60, illustrated in FIG. 3. The integration of this housing function of the controller 60 by the case forming the guide rail allows greater freedom in the design for the controller 60. It is in particular possible to consider a greater bulk of the controller 60 than in traditional systems, since the volume 36 may be enlarged in the main extension direction of the guide rail 28 without hindering the overall compactness of the proposed device.

When the case 20 is adapted to house the controller 60, the case 20 may also form a separating wall 64, as illustrated in FIGS. 3 and 4. Such a separating wall 64 makes it possible to create separate zones in the case 20, a first zone being intended to house the mechanical reducer and a second zone being intended to house the controller 60, preventing pollution of the controller by oil or grease lubricating the mechanical reducer. The zone intended to house the controller 60 is then called a "clean" zone.

Figure 6:
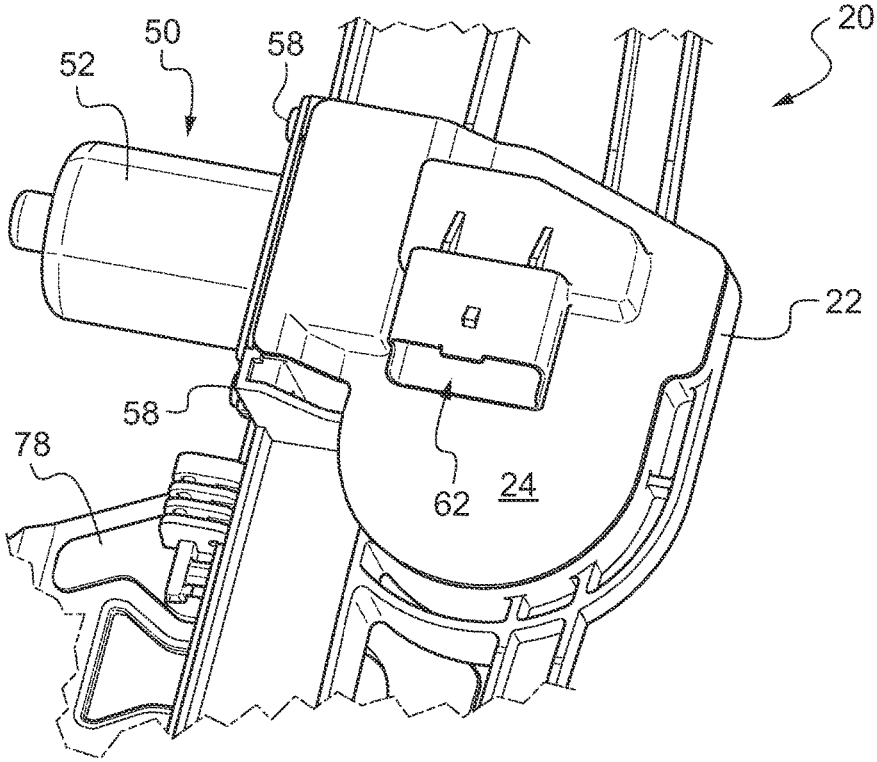
FIG. 6, a view of a half-shell of the mechanical reducer case forming a guide rail, bearing a complementary half-shell.
Figure 7:
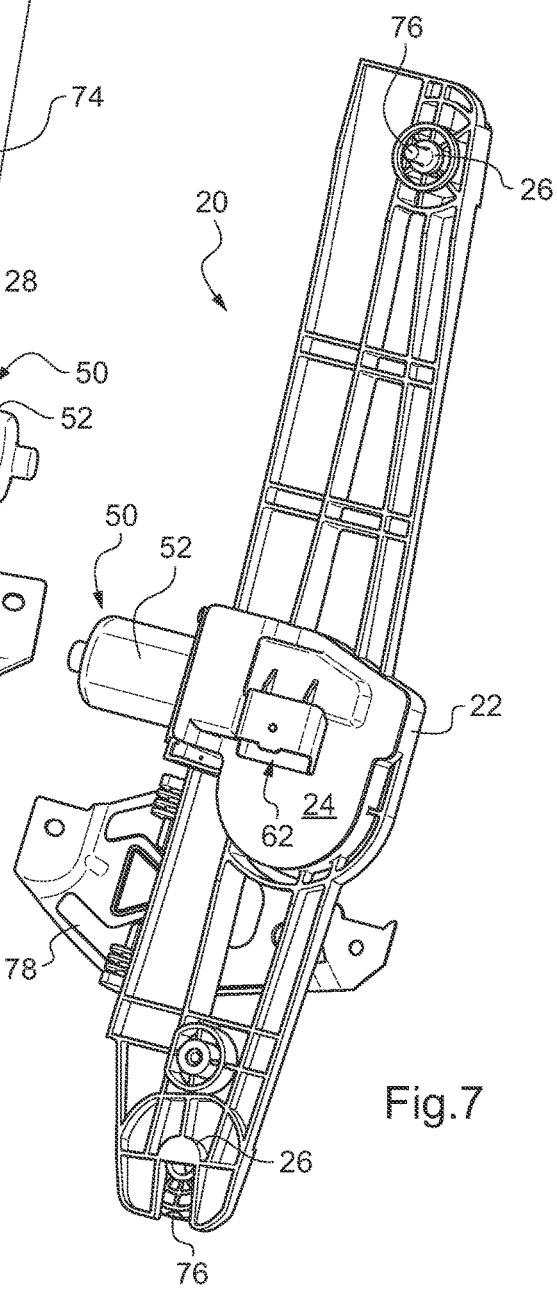
FIG. 7, an overall rear perspective view of the case of FIG. 6.

According to one embodiment having greater integration of the controller 60, the case 20 may include a connection interface arranged to receive an electric cable connector outside the case 20. The connection interface thus makes it possible to receive instructions and/or electricity inside the case coming from outside the case 20. The received instructions are intended for the controller 60, the connection interface being arranged to be electrically connected to the controller 60, when the controller 60 is housed in the case 20, for example in the volume 36. The electricity received from the outside is intended for the motor assembly 50, but may in particular pass through the controller 60. FIG. 6 shows a view of the half-shell 22 bearing the complementary half-shell 24 to define an inner housing volume of the mechanical reducer. According to the embodiment illustrated in FIG. 6, the connection interface 62 is formed by the complementary half-shell 24. Alternatively, the connection interface 62 may be formed by the half-shell 22 forming the guide rail 28. It may also be considered for the connection interface 62 to be an attached part to be fastened on one of the half-shells 22 or 24, so as for example to facilitate obtaining one or both half-shells pouring or molding without undercut by drawer. FIG. 7 shows an overall rear perspective view of the case 20 closed by the half-shell 24. This FIG. 7 in particular illustrates the bearing 26 formed by the case 20 or one of the pulleys 76.

In reference to FIG. 4, the electricity intended for the motor is assembly 50 may be transmitted to the rotor 64 by brush holders 66 coming into contact with a rotor collector 56. In this document, the term "brush holder" corresponds to the assembly formed by a brush support and the brush as such. The proposed case 20 may then include a volume 38, as illustrated in FIG. 3, for housing the brush holders 66. The volume 38 is then adapted so that the brush holders 66 are received in a position where the brush holders 66 come into contact with the rotor collector 56 when the motor assembly 50 is mounted on the case 20. The volume 38 then performs a collector box function. Alternatively, not shown, the collector box function may not be integrated into the case 20. This function may then be integrated into the motor assembly 50 independently of its subsequent mounting on the proposed case 20. The motor assembly 50 then also includes the brush holders 66 in contact with the rotor collector as well as a housing receiving the brush holders 66. Such a motor assembly is also proposed here.

According to one preferred embodiment, the proposed drive system may include a polarized magnetic ring on the shaft of the rotor 54, i.e. on the shaft supplying the motor torque for the mechanical reducer. During rotation of the rotor 54, the variation of the orientation of the magnetic field produced by the ring may be collected in the form of a signal that can be transmitted to the control electronics 60 so that the latter can deduce the position of the opening therefrom by counting signals and detect any anomaly in the movement such as, for example, pinching of an obstacle. According to the embodiments of the case 20, the volume 38 defined by the case 20 to house the brush holders 66 may also be used to house the polarized magnetic ring on the rotor shaft 54. FIG. 4 shows such a magnetic positioning ring 55, with the controller 60 housed in the volume 36 extending in the volume 38 to receive magnetic signal sensors therein, for example of the Hall effect type. Alternatively but not shown, magnetic flux conductors may convey the magnetic field, and therefore the variation thereof, from the ring 55 to sensors housed with the controller 60 in the volume 36. When the motor assembly 50 houses the brush holders, the housing of the brush holders can also house the magnetic positioning ring. This motor assembly 50 housing the magnetic ring is also proposed here. In this embodiment of the motor assembly 50, the electronic controller is included in the motor assembly, which includes an electronic controller housing. The motor assembly 50 may also include the electronic controller and the housing for the electronic controller independently of the presence of a magnetic positioning ring in the proposed drive system.

To facilitate the mounting of the motor assembly 50 on the case 20, the case may include a mounting interface.

According to one alternative, the mounting interface is arranged to receive the motor assembly 50 in a mounted position by translating the motor assembly in the extension direction of the rotor. FIG. 3 shows one possible embodiment of the mounting interface 80 according to this alternative. The assembly of the motor assembly 50 with the case 20 bearing such a mounting interface 80 is illustrated in FIG. 4, where the motor assembly 50, housed in the yoke 52, can be received by insertion in the case 20 in the direction 40 of the motor shaft, i.e. in the direction of extension of the rotor 54. According to this embodiment, the motor assembly 50 is then fastened to the mounting interface 80 of the case 20 by screws 58, here three (only two of which are visible).

According to another alternative, the mounting interface is of the bayonet type. In other words, according to this alternative, the mounting interface is arranged to receive the motor assembly 50 in the mounted position through rotation around the extension direction of the rotor 54, after the rotor 54 is inserted in the case 20.

Figure 8:
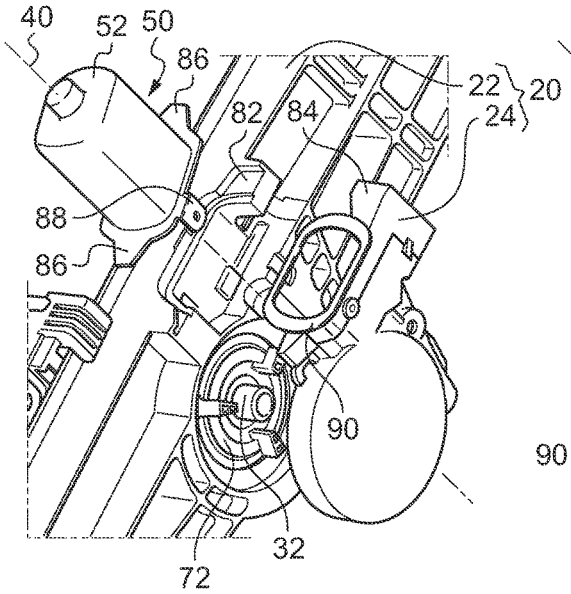
FIGS. 8, 9, 10 and 11, perspective views of different steps of mounting a motor assembly on a mounting interface of the case of the bayonet type.
Figure 9:
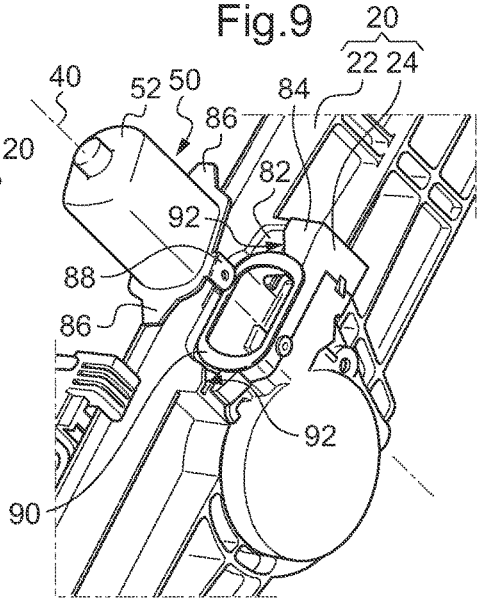
Figure 10:
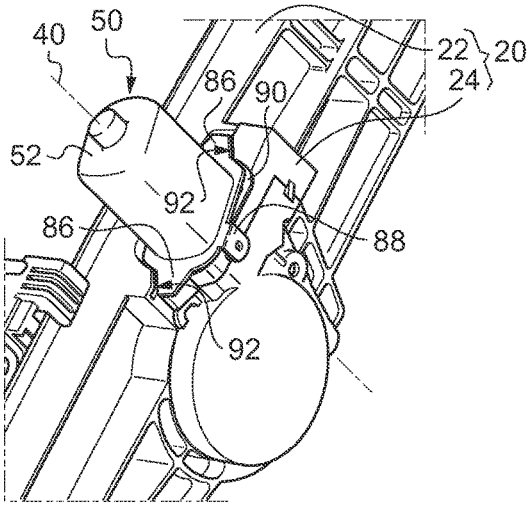

FIGS. 8, 9, 10 and 11 show perspective views of different steps of mounting the motor assembly 50 on the mounting interface of the case 20 of the bayonet type. In these FIGS. 8 to 11, the motor assembly 50 is shown diagrammatically using the yoke 52, the rotor 54, previously described, in particular not being illustrated here. Furthermore, the wheel 46 previously described is also not illustrated in FIG. 8. The mounting interface of the bayonet type here is illustrated as being made up of two parts, a first part 82 on the half-shell 22 and a second part 84 on the half-shell 24. The obtainment of the mounting interface of the motor assembly 50 then assumes the assembly of the two half-shells 22 and 24, here in the extension direction of the shaft 32. FIG. 9 illustrates such an assembly with two half-shells, whereas FIG. 8 illustrates the two half-shells before assembly. The mounting interface thus formed can receive the motor assembly 50 by insertion in the shaft of the rotor, here in the direction 40. FIG. 10 illustrates the proposed drive system after insertion of the motor assembly 50 in the direction 40. The motor assembly 50 is then positioned in the mounted position through rotation around the extension direction of the rotor 54, here in the direction 40.

Figure 11:
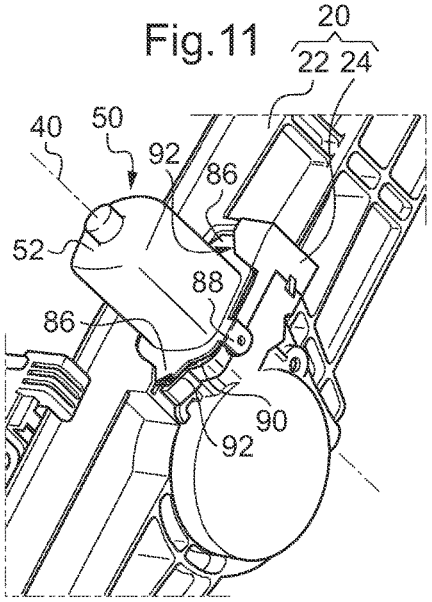

The yoke 52 and the mounting interface 82 and 84 include shapes adapted to allow such bayonet mounting. Thus, in reference to FIGS. 8 to 11, the yoke 52 may include ears 86 and the mounting interface may include corresponding notches 92, the notches 92 for example being in the portion 82 and the portion 84 of the mounting interface. Said ears 86 and said notches 92 are adapted to one another to cooperate as illustrated in FIG. 11 after the motor assembly 50 is rotated around the extension axis of the rotor, here the direction 40. The yoke 52 may also include an ear with holes 88, provided to be placed opposite a corresponding hole on the case 20, after positioning the motor assembly 50 in the mounting position. This ear with holes 88 makes it possible to ensure maintenance of the motor assembly 50 in the mounting position using one screw (not shown).

In reference to the embodiment above, proposed in particular is a method for mounting the motor assembly 50 with the case 20 using a mounting interface 82 and 84 of the bayonet type. Furthermore, also proposed is the motor assembly 50 including a stator and rotor 54 as well as the yoke 52 with ears 86 adapted to be mounted on the case 20 including the bayonet mounting interface 82 and 84.

The obtained advantages may not be the same depending on the alternative of the fastening interface. In the case of the first alternative of the mounting interface 80, the thickness of the drive system may be greatly decreased. This decrease in the thickness is in particular useful when the system is to be mounted in a motor vehicle door, the savings in terms of thickness of the proposed system being savings in the direction Y of the vehicle reference, or in the thickness of the door. This possible reduction of the thickness is smaller in the case of the second alternative due to the presence of the shapes adapted to allow bayonet mounting. However, in the case of the second alternative of the mounting interface 82 and 84, a reduction is obtained in the mounting times of the proposed system, by limiting the number of mounting screws for mounting the motor assembly 50 on the case 20.

FIGS. 8 to 11 also show that a seal 90 may be added in any case between the yoke 52 and the case 20. This seal 90 ensures sealing of the proposed drive system at the mounting interface. Similarly, it may be useful to provide a seal at the junction of the two half-shells 22 and 24. In the context of an application of the drive system for a motor vehicle door window, the seal 90 or the seal at the junction of the half-shells 22 and 24 both make it possible to delimit the wet area outside the inner volumes of the case 20 and the yoke 52. Furthermore, the proposed drive system may also include a seal at an interface between the drum 72 and the wheel 56 to delimit the wet area completely outside the volumes of the proposed actuating system where electrical or electronic parts are housed. The seal may also be placed between the wheels 56 and the housing 30*a*.

According to the embodiments previously described, the integration of the function of housing the mechanical reducer is provided on the guide rail of a drive system for an opening of the so-called "cable and drum" type. A system for driving the opening is also provided of the so-called "sector arm" type. Such a type of drive system includes an arm hinged in rotation relative to a platen. The platen bears a gear motor driving a pinion and the arm bears a rack in the form of an angular sector. The pinion and sector-shaped rack form a gear. Depending on the actuation of the gear motor, the arm opens or closes relative to the platen, respectively causing the opening connected to the arm to be closed or open. According to the proposed "sector arm" drive system, the function of housing the mechanical reducer forming the gear motor may be integrated into the platen. A platen of a drive system for an opening of the "sector arm" type is thus proposed defining a housing volume of a mechanical reducer for converting a motor torque into a drive torque of the opening. In other words, a mechanical reducer case is proposed for converting a motor torque into a drive torque of an opening, the case forming an opening drive system platen of the "sector arm" type. The proposed platen is advantageously made from plastic. Furthermore, the proposed platen may define a combination of the different housing volumes previously defined by the opening actuating system case of the "cable and drum" type. The proposed platen forms a system for driving the opening, also proposed, when the platen houses the different members in their respective volume of the combination of volumes defined by the platen.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mechanical reducer case for a window lift and for converting motor torque into driving torque for an opening, the case comprising:

a shell forming alone a guide rail guiding a slider movably secured to the guide rail and associated with the opening into a closed position or into an open position, the shell defining a volume completely surrounding a mechanical reducer, the mechanical reducer comprising a wheel meshing with a worm screw and the volume supporting at least partially a motor shaft supplying the motor torque to the mechanical reducer and the shell being a single piece with an integral shaft for rotatably receiving the wheel, wherein the guide rail extends from opposite sides of the volume; and a complementary cover configured to be secured to the shell, wherein the complementary shell and the shell define the volume when they are secured together.

2. The mechanical reducer case according to claim 1, wherein the case is made from plastic.

3. The mechanical reducer case according to claim 1, wherein the case is configured to receive bearings of the motor shaft that supplies the motor torque for the mechanical reducer and the shell of the case further comprises positioning stops for positioning the bearings in a first direction that is perpendicular to a direction of the shaft and extends along a plane of the shell.

4. The mechanical reducer case according to claim 1, wherein the volume houses a drum using a cable to drive the slider along the guide rail formed by the case.

5. The mechanical reducer case according to claim 1, wherein the window lift is for a motor vehicle door, and wherein the case includes interfaces for fastening to the motor vehicle door, the fastening interfaces being arranged: at opposite ends of the guide rail in a main extension direction of the guide rail and a portion of the case defining the volume for housing the mechanical reducer.

6. The mechanical reducer case according to claim 1, wherein the case further defines another volume for housing an electronic controller configured to control actuation of the slider into the closed position or the open position.

7. The mechanical reducer case according to claim 6, wherein the case further comprises a connection interface arranged to be electrically connected to the electronic controller received in the housing configured to house the electronic controller and the electronic controller being configured to receive an electric cable connector outside the case.

8. The mechanical reducer case according to claim 6, wherein the case further comprises a separating wall located between the volume for the mechanical reducer and the another volume for the electronic controller.

9. The mechanical reducer case according to claim 6, wherein the case includes another volume configured to receive a magnetic ring configured to position the motor shaft.

10. The mechanical reducer case according to claim 1, further comprising an interface for mounting a motor assembly including a stator and rotor to the case, the mounting interface configured to receive the motor assembly in a mounted position by translating the motor assembly in an extension direction of the rotor.

11. The mechanical reducer case according to claim 10, further comprising another volume configured to receiving brush holders in a position wherein the brush holders come into contact with a rotor collector when the motor assembly is received in a mounted position by the mounting interface.

12. The mechanical reducer case according to claim 1, further comprising a pair of pulleys located at opposite ends of the mechanical reducer case.

13. A mechanical reducer case for a window lift and for converting motor torque into driving torque for an opening, the case comprising:

a shell forming alone a guide rail for guiding a slider movably secured to the guide rail and associated with the opening into a closed position or into an open position, the shell defining a volume for completely surrounding a peripheral portion of a mechanical reducer, the mechanical reducer comprising a wheel and a worm screw and the volume being suitable for housing at least partially a motor shaft supplying the motor torque to the mechanical reducer, wherein the guide rail extends from opposite sides of the volume; and a shaft, wherein the shell is a single piece with the shaft integrally formed therewith and a portion of the volume is positioned around the shaft and configured to receive a wheel cooperating with the shaft, the wheel being configured to supply a torque output of the mechanical reducer, wherein the portion of the volume receives a drum configured to use a cable for driving the slider along the guide rail formed by the case.

* * * * *